United States Patent [19]

Leyland et al.

[11] Patent Number: 5,034,654

[45] Date of Patent: Jul. 23, 1991

[54] BEAM FOCUSING MEANS FOR A CRT ELECTRON GUN ASSEMBLY

[76] Inventors: John D. Leyland, 4 The Meadows, Grotton, Oldham, United Kingdom, OL4 4LR; John R. Banbury, 13 Dinorben Beeches, Fleet, Hampshire, United Kingdom, GU13 9SR

[21] Appl. No.: 541,486

[22] Filed: Jun. 21, 1990

Related U.S. Application Data

[63] Continuation of Ser. No. 279,361, Dec. 2, 1988, abandoned.

[30] Foreign Application Priority Data

Dec. 4, 1987 [GB] United Kingdom ..... 8728481

[51] Int. Cl.[5] ..... H01J 29/62

[52] U.S. Cl. ..... 313/449; 313/414; 315/16

[58] Field of Search ..... 313/414, 449, 448, 458, 313/460; 315/14–16

[56] References Cited

U.S. PATENT DOCUMENTS 4,201,933 5/1980 Hisada et al. ..... 315/16
4,374,341 2/1983 Say ..... 313/414

FOREIGN PATENT DOCUMENTS 0113113 7/1984 European Pat. Off. .
0214816 3/1987 European Pat. Off. .

OTHER PUBLICATIONS

P. Grivet, *Electron Optics,* pp. 384–385 (Permagon Press, 2d ed., 1972; translated by P. W. Hawkes) ("Grivet").

H. Moss, *Narrow Angle Electron Guns and Cathode Ray Tubes,* pp. 181–189 (Academic Press, 1968) ("Moss").

*Primary Examiner*—Donald J. Yusko
*Assistant Examiner*—Michael Horabik
*Attorney, Agent, or Firm*—Lerner, David, Littenberg, Krumholz & Mentlik

[57] ABSTRACT

The gun comprises a cathode, a control grid, a first anode a second anode and a third anode. Preferably a beam width limiting aperture is provided in the first anode. In one example the current modulating voltage applied to the grid is 0 to −50V, the voltage applied to the first anode is +5 kV, the focus voltage applied to the second anode is +500V, and the EHT voltage applied to the third anode is +25 kV. A main focussing lens is formed by the second and third anodes, but the spacing of the first and third anodes is small so that the focussing effect is also substantially dependent on the voltage of the first anode. The field strength between the grid and first anode is high, which combined with the high first voltage produces a small crossover.

20 Claims, 6 Drawing Sheets

BEAM FOCUSING MEANS FOR A CRT ELECTRON GUN ASSEMBLY

This is a continuation, of application Ser. No. 07/279,361 filed Dec. 2, 1988, now abandoned.

Field of the Invention

This invention relates to cathode ray tubes and to electron guns therefor.

Background to the Invention

A known type of gun with which the invention is concerned comprises a cathode for emitting a beam of electrons, a grid for controlling the beam current, a series of anodes for directing and focussing the electron beam, and means for applying voltages to the cathode, grid and anodes.

An example of the known gun is shown schematically in FIGS. 1A and 1B. The gun comprises a tetrode emission zone and a bipotential electron lens. The emission zone comprises an oxide cathode C′ heated by a heater and considered to be maintained at a zero voltage; a grid G′ to which a beam current modulating voltage ranging typically between 0 V and −50 V is applied; a first anode A1′ to which a voltage of 350 V is applied; and a second anode A2′ to which a voltage of 2.4 kV is applied. The bipotential lens is formed by the second anode A2′ and a third or final accelerating anode A3′ to which an EHT voltage of 23 kV is applied. The emission zone comprising the cathode C′, grid G′, first anode A1′ and second anode A2′ serves to form a beam of electrons which converge to a crossover point X′ between the grid G′ and first anode A1′ and thereafter diverge. The second and third anodes A2′, A3′ function as an electron lens L′ which images the crossover point X′ onto the screen S of the CRT. The size of the image on the screen S is dependent on the size of the crossover point and the magnification factor of the gun. Conventionally, the focal length of the lens L′ is adjusted by adjusting the voltage of the second anode A2′, which is conventionally referred to as the focussing anode.

SUMMARY OF THE INVENTION

One aspect of the present invention is concerned with reducing the size of the crossover, and thus of the image thereof on the screen, compared with the known gun. In accordance with this aspect of the invention, the voltage applied to the first anode is higher than in a corresponding conventional gun and in particular is greater than the voltage applied to the focussing anode. As a result, a high electric field is formed between the grid and the first anode which tends to reduce the size of the crossover.

In the known gun, the position of the crossover varies as the grid modulating voltage varies, resulting in an undesirable variation in the focus of the beam on the screen. A second aspect of the present invention is concerned with reducing the dependence of focus on grid voltage. In accordance with the second aspect of the invention, the ratio between the voltage of the first anode and the range of the grid modulating voltage is greater than in a corresponding conventional gun, and in particular the first anode voltage is at least twenty times greater than the grid voltage range. Preferably, said ratio is at least thirty, more preferably at least fifty, and desirably at least eighty.

Given that, in accordance with the first and second aspects of the invention, the first anode voltage is higher than is conventional, the third aspect of the invention seeks to utilise this high voltage in controlling the beam size. In accordance with the third aspect of the invention, a beam limiting member is disposed to the side of the first anode which is remote from the grid, the beam limiting member having an aperture to limit the cross-section of the electron beam passing therethrough, and a voltage being applied to the beam limiting member about equal to that of the first anode and substantially more than the voltage of the second anode. It will be appreciated that electrons in the peripheral region of the electron beam will impinge on the beam limiting member and result in some secondary emission of electrons from the beam limiting member. However, because the second anode voltage is less than the voltage of the beam limiting member, these secondary electrons will tend to be attracted back to the beam limiting member or first anode, rather than passing to the screen where they would otherwise reduce the contrast and resolution of the image.

It will be appreciated that the three aspects of the invention mentioned above may all be employed in the same gun.

Various embodiments of the invention will now be described by way of example with reference to the accompanying drawings.

DESCRIPTION OF THE SPECIFIC EMBODIMENTS

Figure 2:
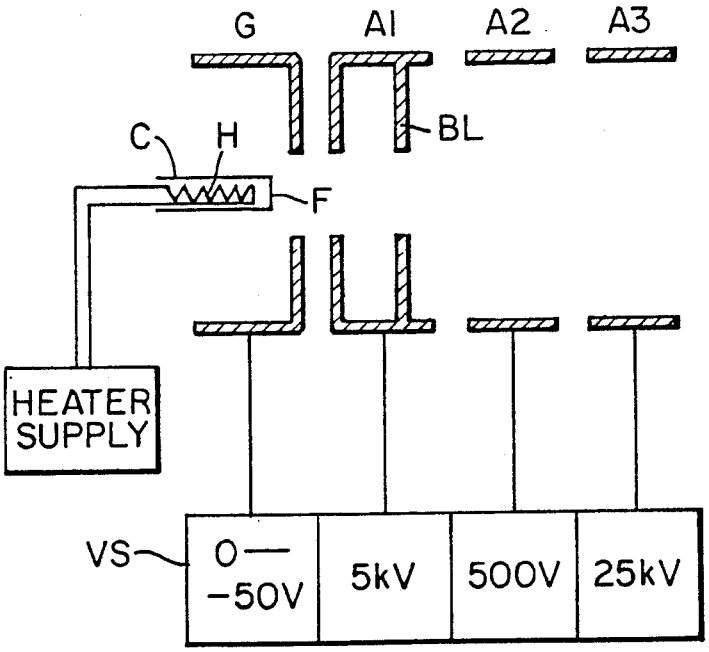
FIG. 2 is a schematic diagram of an electron gun in accordance with the invention.

Referring to FIG. 2, the electron gun comprises a cathode C a control grid G, a first anode A1, a second anode A2 and a third anode A3. Preferably, a beam limiting aperture BL is provided. As shown in FIG. 2 the aperture BL is provided in the first anode A1. The grid G and anodes A1, A2 and A3 are energised by a voltage supply arrangement VS; such a voltage supply arrangement is well known in the art. A conventional heater power supply energises the heater H of the cathode, which in this example is a conventional oxide cathode with a planar emission surface.

In this example, the voltage supply arrangement VS energises the electrodes, as follows:

| | | |
|---|---|---|
| Cathode C: | 0 V | |
| Grid G: | Variable | (VG) varying between: |
| | −50 V | (VGC) at cut-off; and |

-continued

| | | |
|---|---|---|
| | 0 V | (VGF) at full emission |
| Anode A1 | +5 kV | (V1) |
| Anode A2 | 500 V | (V2) focus voltage |
| Anode A3 | 25 kV | (V3) EHT |

The spacing S between the grid G and the first anode A1 is about 1.5 mm. The nominal field strength between the first anode A1 and the grid G at full emission is (V1−VGF)/S=3.3 kV/mm.

The result of the high field strength and the high voltage of the first anode is a small crossover between the grid G and first anode A1. At the crossover part the electrons are packed closely together and they tend to mutually repel each other increasing the size of the crossover. The high field strength combined with the high voltage of the first anode tends to cause the electrons to pack more closely together producing a small crossover.

It is known in the art that the position of the crossover varies as the modulating voltage VG applied to the grid G varies resulting in variation of focussing with modulating voltage. The modulating voltage VG is varied between cut off VGC (−50 V in this example) to full emission VGF (OV). In the electron gun of FIG. 2, the variation of focussing and the position of the crossover with modulation is reduced as compared to the known gun of FIG. 1A. It is believed that this improvement occurs because the ratio of the voltage V1 of the first anode to the range (VGF-VGC) of the modulating grid voltage is much greater than in the known guns. In the example, the ratio is 100:1. Preferably it is at least 20:1, more preferably at least 30:1 and more preferably at least 80:1.

As noted above, the focus voltage applied to the focus electrode A2 is 500 V as compared to the 2.3 KV of the known gun. This is advantageous because it greatly simplifies the production of the focus voltage and allows "direct drive" of the focus electrode A2, and also simplifies dynamic variation of focus as the beam is scanned across the screen of a CRT, if dynamic focus variation is desired.

The focus voltage (+500 V) applied to the focus electrode A2 is less than the voltage (+5 kV) applied to the first anode A1. If the beam limiter BL is provided on the first anode A1, electrons hitting it generate secondary electrons which, if they reached the screen of the CRT, would tend to reduce contrast and resolution. However, because the voltage of A2 is less than the voltage of A1, the secondary electrons are attracted back to A1 and so do not reach the screen improving contrast and resolution.

Figure 1A:
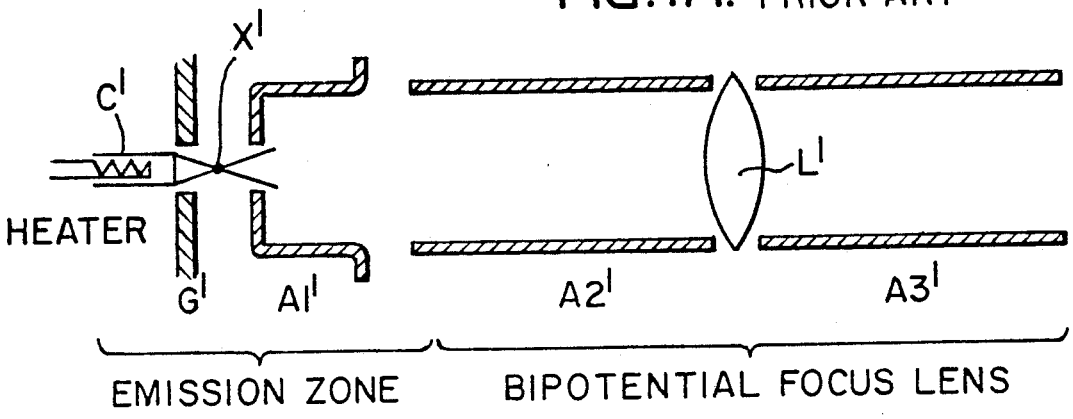
FIG.1A. PRIOR ART
FIGS. 1A and 1B relate to a known electron gun.
Figure 1B:
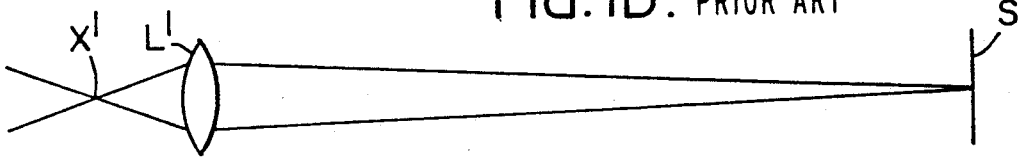
FIG.1B. PRIOR ART
Figure 3:
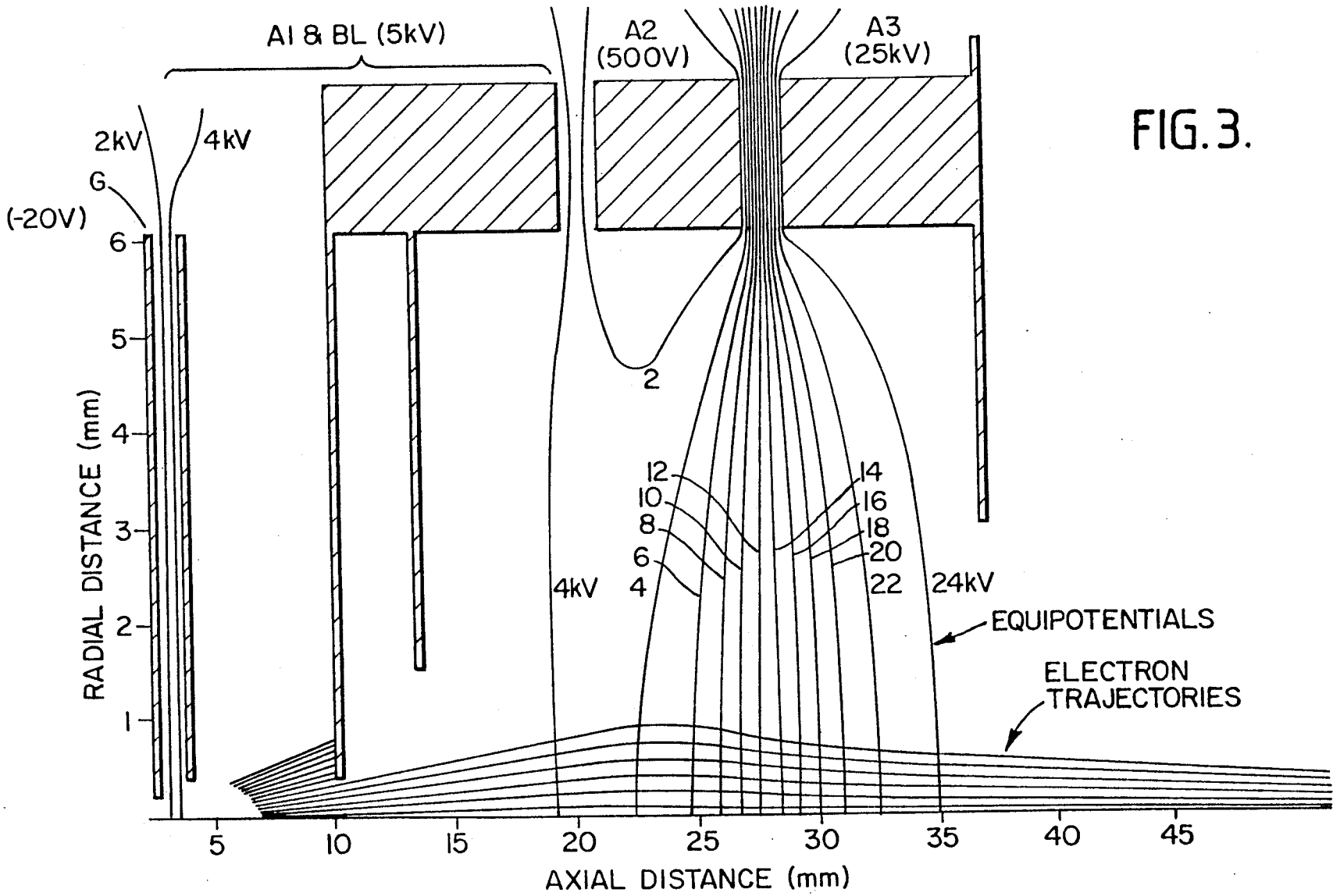
FIG. 3 is a schematic diagram showing equipotentials forming a focus lens, the diagram having unequal scales horizontally and vertically.

The electron gun of FIG. 2 is short, being shorter than the known gun of FIG. 1A. As a result of the shortness of the gun, and the relatively high voltage of first anode A1, the main focus lens is dependent not only on the voltage applied to anodes A2 and A3 but also dependent on the voltage applied to A1. That dependence is apparent from the equipotential diagram of FIG. 3.

The electron gun of FIG. 2 provides constant throughput independent of the EHT voltage applied to anode A3. Throughput is the ratio of beam current reaching the screen of the CRT to the current emitted by the cathode. Throughput is constant because, although changing the EHT voltage will change the focussing potential, since the beam limiting aperture connected to A1 is in a field free region, at e.g. a fixed voltage of 3 to 5 kV, no change in the beam envelope at, or prior to, the aperture will occur.

The high field strength in anode A1-grid G region gives a high cut-off value which is reduced by increasing the spacing of the grid G from the cathode C, thus easing problems of construction of the gun.

Whilst the EHT voltage applied to anode A3 has been described above as constant, it may be varied in the range approximately 7 kV to 30 kV. The gun may then be used in a penetron CRT in which the phosphors are selected according to the energy of the beam.

The field strength between grid G and anode A1 is preferably greater than 2 kV per mm and is preferably 3 kV per mm or more, for a gun in which the grid aperture diameter is approximately 0.4 mm.

It is well known in the art that spot size at the screen can be increased or decreased by an increase or reduction of the grid aperture diameter, and that for an electron gun having a given beam exit angle at a given drive level, the spacing between grid and first anode is scaled in accordance with the change made in grid aperture diameter. An electron gun in accordance with the invention is applicable to a wide range of cathode ray tube screen sizes and resolution values, therefore it may use any grid aperture diameter in the range 0.2 to 1 mm. The first anode voltage required must be at least 2 kV, for the smaller grid aperture diameters (0.2 to 0.25 mm), but at least 3 kV and preferably 5 kV for the larger grid aperture diameters (0.5 to 1 mm).

Figure 4A:
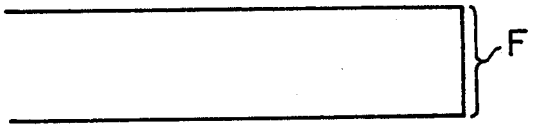
FIGS. 4A and 4B illustrate alternative cathode configurations.

The cathode C has been described hereinbefore as an oxide cathode having a planar emission face F. It may be replaced by a dispenser cathode having a planar emission face F; see FIG. 4A.

Figure 4B:
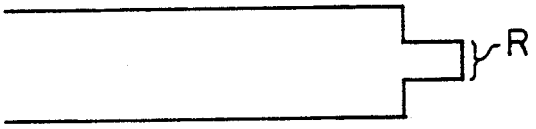
Figure 5A:
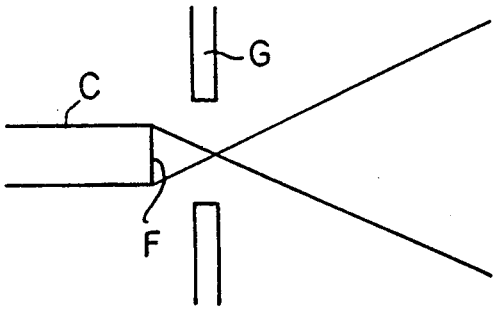
FIGS. 5A and 5B illustrate beam angles produced by the cathodes of FIGS. 4A and 4B.
Figure 5B:
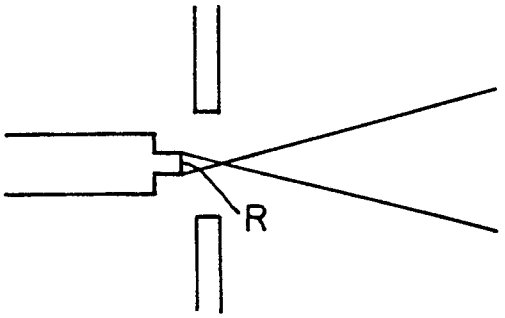

The cathode C may be replaced by a dispenser cathode having a more restricted planar emission face R as shown in FIG. 4B. As shown in FIG. 4B the emission surface is substantially smaller than the axially facing cross sectional area of the cathode. Such a cathode has the advantage of producing a beam of smaller conical angle than the cathode of FIG. 4A (see FIGS. 5A, 5B) especially under conditions of maximum current output. The area from which the current is emitted increases with increasing emission.

A gun in accordance with the invention is capable of being designed to give better corner resolution and depth of focus than a known bipotential gun as described with reference to FIGS. 1A and B. This is achievable by having a short gun having high throughput and a small angle of beam convergence at the screen of the CRT.

EXAMPLE

Figure 6:
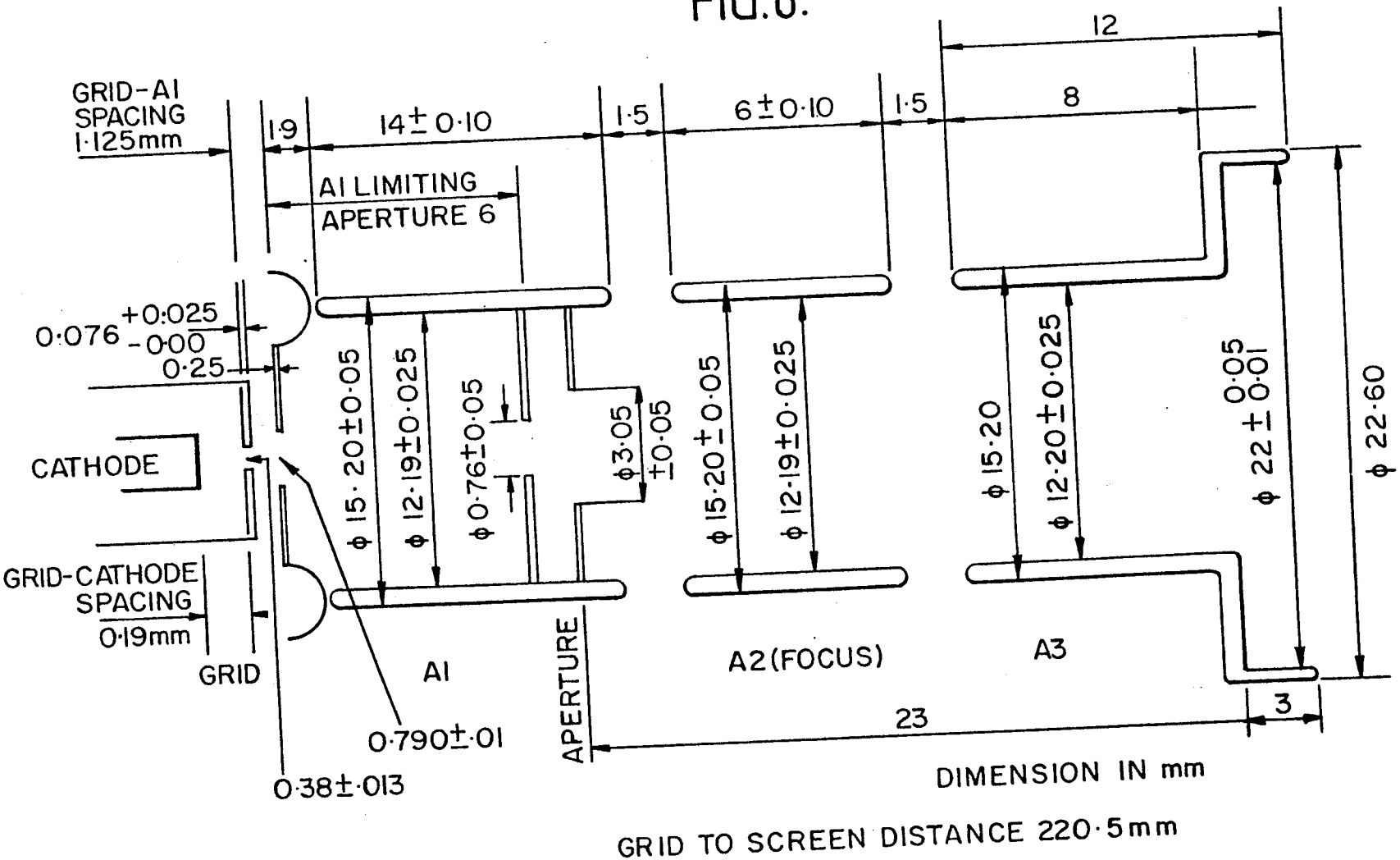
FIG. 6 is a diagram illustrating another embodiment of an electron gun in accordance with the invention showing illustrative dimensions.

FIG. 6 shows an electron gun having good resolution in accordance with the invention, the Figure bearing illustrative dimensions. (Another gun (not illustrated) in accordance with the invention is shorter and has higher throughput but lesser resolution).

Figure 7:
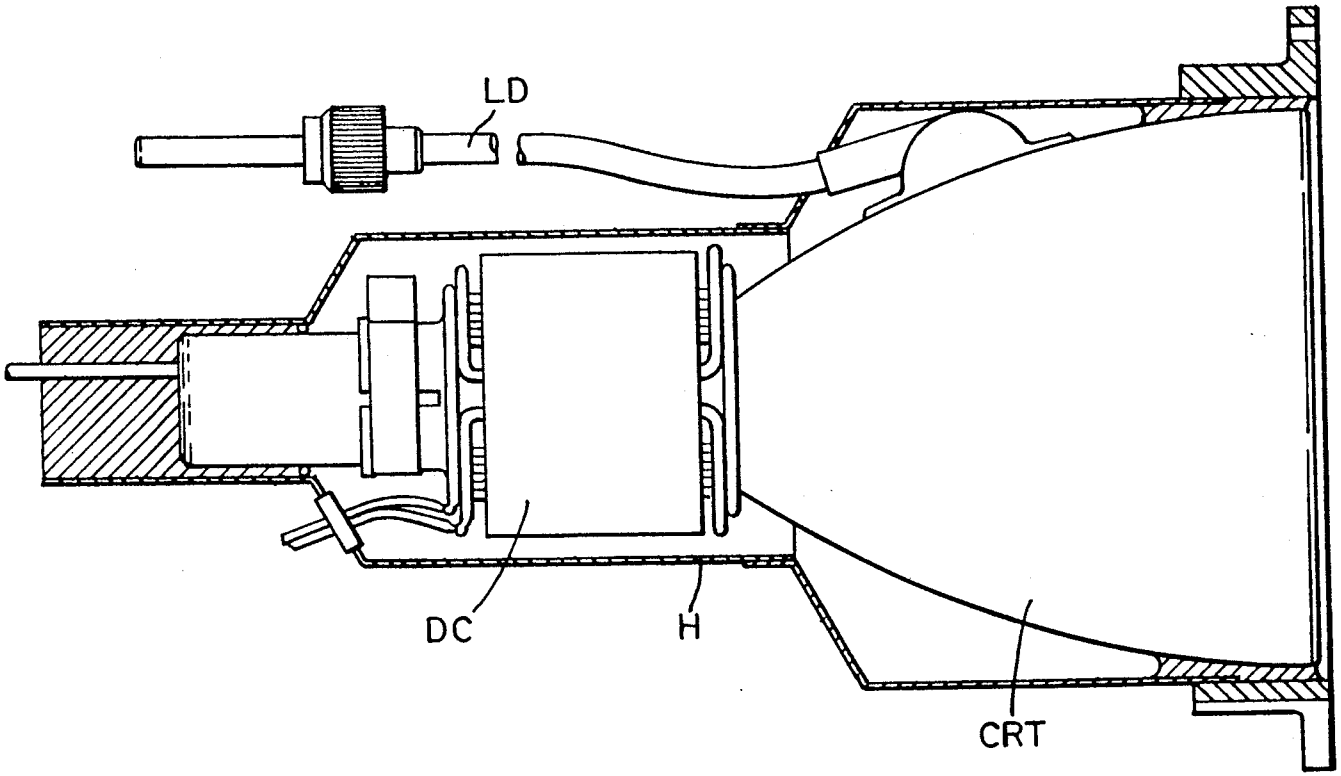
FIG. 7 is a cross-section diagram of a CRT including the gun of FIG. 6.

FIG. 7 is a cross section diagram of a CRT including the gun of FIG. 6.

FIGS. 6 and 7 use the same references as FIGS. 1 to 5.

In FIG. 7 the CRT is provided with a deflection coil DC and the assembly of the CRT and deflector coil is sealed within a housing H. The CRT is, as is conventional, provided with an EHT lead LD.

Figure 8:
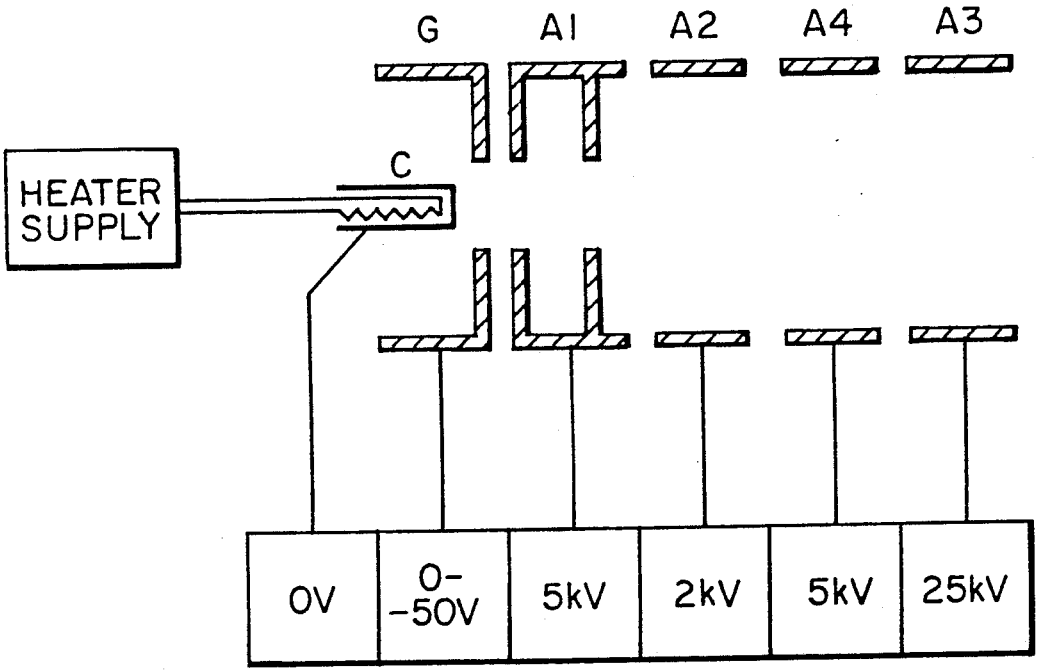
FIG. 8 is a schematic illustration of a modified electron gun.

Referring to FIG. 8, in a modified embodiment of the invention an additional anode A4 is interposed between the main focus electrode A2 and final anode A3, connected to an intermediate voltage between V2 and V3, so that acceleration of the beam after passage though the focus electrode is accomplished in two stages (or, in a further extension, by a plurality of accelerating electrodes). Conveniently, the extra electrode A4 is connected electrically to the first anode A1. The resulting four-electrode focusing lens comprising A1, A2, A4, A3, has the ability to produce lower aberrations than a three-electrode lens A1, A2, A3, and the voltage applied to A2 (typically 1 to 4 kV) remains lower than VA1, VA4 and VA3.

In a further modification of the arrangement of FIG. 8, a further short anode A5 is disposed between the first anode A1 and the main focus anode A2, and another short anode A6 is disposed between main focus anode A2 and the additional anode A4. As an example, the voltages applied to the electrodes may be as follows:

| | |
|---|---|
| Cathode C | 0 V |
| Grid G | 0–150 V |
| First Anode Al | 5 kV |
| Anode A5 | 4 kV |
| Focus Anode A2 | 3 kV |
| Anode A6 | 4 kV |
| Anode A4 | 5 kV |
| Final Anode | 25 kV |

The additional electrode A5 provide progressively controlled deceleration to the main focus anode A2 (which of the electrodes forming the electron lens is at the lowest voltage), and the additional anodes A6, A4 provide progressively controlled acceleration. This progressive control serves to reduce aberrations.

We claim:

1. A cathode ray tube including an electron gun for emitting and focussing an electron beam comprising:
   a cathode for emitting a beam of electrons;
   a grid for controlling the beam current;
   a series of anodes for directing and focussing the electron beam, the series including a first accelerating anode immediately after said grid, a first focussing anode immediately after said first accelerating electrode and a final anode;
   means for applying voltages to the anodes and a modulating voltage between the gird and the cathode, the voltage applied to the first accelerating anode being substantially greater than the voltage applied to the first focussing anode, the voltage applied to the final anode being greater than the voltage applied to the first accelerating anode, the modulating voltage ranging between a beam cut-off voltage and a full emission voltage, and the voltage applied to the first accelerating anode being greater than fifty times greater than the range of the modulating voltage.

2. A cathode ray tube as claimed in claim 1, wherein the voltage applied to the first accelerating anode is at least eighty times greater than the range of the modulating voltage.

3. A cathode ray tube according to claim 1, wherein the cathode is an oxide cathode.

4. A cathode ray tube according to claim 3, wherein the cathode has an emission surface area substantially smaller than the cross-sectional area of the cathode.

5. A cathode ray tube including an electron gun for emitting and focussing an electron beam, comprising:
   a cathode for emitting a beam of electrons;
   a grid for controlling the beam current;
   a series of anodes for directing and focussing the beam current and including a first accelerating anode immediately after said grid, a first focussing anode immediately after said first accelerating anode, and a final anode;
   a beam limiting member disposed to that side of the first accelerating anode which is remote from the grid, the beam limiting member having an aperture to limit the cross-section of the electron beam passing therethrough; and
   means for applying voltages to the anodes, and beam limiting member and a modulating voltage between the grid and the cathode, the voltage applied to the beam limiting member being about equal to the voltage applied to the first accelerating anode and substantially more than the voltage applied to the first focussing anode, and the voltage applied to the first accelerating anode being greater than fifty times greater than the range of the modulating voltage.

6. A cathode ray tube as claimed in claim 5, wherein the first accelerating anode and the beam limiting member are mounted together and are electrically connected so that the limiting member voltage is equal to the voltage applied to the first accelerating anode.

7. A cathode ray tube according to claim 5, wherein the first accelerating anode comprises a plurality of axially separated components maintained at substantially the same potential.

8. A cathode ray tube according to claim 5, wherein the voltage applied to the first accelerating anode is substantially less than the voltage applied to the final anode.

9. A cathode ray tube as claimed in claim 1 or 5, wherein the nominal electric field between the first accelerating anode and the grid at the full emission grid voltage is at least 2 kV/mm.

10. A cathode ray tube as claimed in claim 1 or 5, wherein the nominal electric field between the first accelerating anode and the grid at the full emission grid voltage is at least 3 kV/mm.

11. A cathode ray tube according to claim 1 or 5, wherein the first accelerating anode is axially extended to form a substantially field free region there within.

12. A cathode ray tube as claimed in claim 1 or 5, wherein at least one further anode is disposed between the first focussing anode and the final anode, the voltage applied to each further anode being between the voltages applied to the preceding and succeeding anodes.

13. A cathode ray tube as claimed in claim 1 or 5, wherein at least one other anode is disposed after the first focussing anode, the voltage applied to each said other anode being below the voltage applied to the preceding anode.

14. A cathode ray tube according to claim 1 or 5, wherein the spacing of the final anode from the first accelerating anode is sufficiently small that the main focus lens is substantially dependent on the voltages applied to the first accelerating, first focussing and final anodes.

15. A cathode ray tube according to claim 1 or 5, wherein the voltage applied to the first accelerating anode is greater than 2 kV.

16. A cathode ray tube according to claim 15, wherein the first accelerating anode voltage is about 5 kV.

17. A cathode ray tube according to claim 1 or 5, wherein the cathode is a dispenser cathode.

18. A cathode ray tube according to claim 17, wherein the cathode has an emission surface area substantially smaller than the cross-sectional area of the cathode.

19. A cathode ray tube according to claim 1 or 5, wherein the voltage applied to the final anode is variable.

20. A cathode ray tube according to claim 19, wherein the final anode voltage is variable in the range 7 kV to 30 kV.

* * * * *